US012264413B2

(12) United States Patent
Haynes et al.

(10) Patent No.: US 12,264,413 B2
(45) Date of Patent: Apr. 1, 2025

(54) SPUNBOND SYSTEM AND PROCESS

(71) Applicant: Kimberly-Clark Worldwide, Inc., Neenah, WI (US)

(72) Inventors: Bryan D. Haynes, Jasper, GA (US); Eric E. Lennon, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 97 days.

(21) Appl. No.: 17/908,552

(22) PCT Filed: Mar. 5, 2021

(86) PCT No.: PCT/US2021/021196

§ 371 (c)(1),
(2) Date: Sep. 1, 2022

(87) PCT Pub. No.: WO2021/178882

PCT Pub. Date: Sep. 10, 2021

(65) Prior Publication Data

US 2023/0135016 A1 May 4, 2023

Related U.S. Application Data

(60) Provisional application No. 62/985,712, filed on Mar. 5, 2020.

(51) Int. Cl.
*D01D 4/02* (2006.01)
*D01D 5/088* (2006.01)
(Continued)

(52) U.S. Cl.
CPC ..... *D01D 5/0985* (2013.01); *D01D 5/092* (2013.01); *D01D 10/0436* (2013.01); *D06M 10/025* (2013.01); *D04H 3/03* (2013.01)

(58) Field of Classification Search
CPC ..... D01D 4/02; D01D 5/088; D01D 5/092; D01D 5/098; D01D 5/0985; D01D 5/14;
(Continued)

(56) References Cited

U.S. PATENT DOCUMENTS 4,346,504 A * 8/1982 Birk ..... B65H 51/16 264/555 X
5,688,468 A * 11/1997 Lu ..... D04H 3/16 264/555 X
(Continued)

FOREIGN PATENT DOCUMENTS

EP 1432861 B1 10/2007
EP 1346089 B1 5/2008
(Continued)

OTHER PUBLICATIONS

Lim, Hosun, "A Review of Spunbond Process", Spring 2010, NC State University, https://ojs.cnr.ncsu.edu/index.php/UTATM/article/view/513/602.

*Primary Examiner* — Leo B Tentoni
(74) *Attorney, Agent, or Firm* — KIMBERLY-CLARK WORLDWIDE, INC.

(57) ABSTRACT

A system and method for providing a plurality of fibers from a spinneret; subjecting the fibers to quench air; attenuating the fibers through a closed stretching unit; reducing a velocity of the plurality of fibers in a diffuser that is spaced apart from an exit of the closed stretching unit in a direction of travel of the fibers, the diffuser having opposed diverging sidewalls; and subjecting the fibers to an applied electrostatic charge before the fibers enter the diffuser, wherein the electrostatic charge is applied by one or more electrostatic charging units.

24 Claims, 4 Drawing Sheets

(51) Int. Cl.

| | |
|---|---|
| ***D01D 5/092*** | (2006.01) |
| ***D01D 5/098*** | (2006.01) |
| ***D01D 5/14*** | (2006.01) |
| ***D01D 7/00*** | (2006.01) |
| ***D01D 10/04*** | (2006.01) |
| ***D04H 3/16*** | (2006.01) |
| ***D06M 10/00*** | (2006.01) |
| ***D06M 10/02*** | (2006.01) |
| *D04H 3/03* | (2012.01) |

(58) Field of Classification Search

CPC ..... D01D 7/00; D01D 10/0436; D04H 3/03; D04H 3/16; D06M 10/00; D06M 10/025

USPC ..... 264/103, 211.12, 464, 465, 466, 467, 264/468, 469, 483, 484, 555; 425/66, 425/72.2, 174.8 E, 377, 464

See application file for complete search history.

(56) References Cited

U.S. PATENT DOCUMENTS

| | | | | |
|---|---|---|---|---|
| 7,488,441 | B2 | 2/2009 | Haynes et al. | |
| 7,947,359 | B2 | 5/2011 | Suzuka et al. | |
| 9,212,432 | B2 | 12/2015 | Ferry et al. | |
| 2003/0171054 | A1* | 9/2003 | Bansal | D04H 3/16 442/364 |
| 2004/0028763 | A1 | 2/2004 | Schmit et al. | |
| 2005/0087287 | A1 | 4/2005 | Lennon et al. | |
| 2005/0087288 | A1 | 4/2005 | Haynes et al. | |
| 2010/0228214 | A1 | 9/2010 | Bornemann et al. | |
| 2011/0217404 | A1 | 9/2011 | Dubus | |
| 2011/0217405 | A1 | 9/2011 | Dubus | |
| 2018/0245253 | A1* | 8/2018 | Shimada | D04H 3/16 |

FOREIGN PATENT DOCUMENTS

| | | | |
|---|---|---|---|
| EP | 1630265 | B1 | 2/2009 |
| EP | 2126178 | B1 | 12/2014 |
| JP | 2019043014 | A | 3/2019 |

* cited by examiner

SPUNBOND SYSTEM AND PROCESS

This application claims priority to and benefit of U.S. Patent Application Ser. No. 62/985,712, filed on 5 Mar. 2020, entitled Improved Spunbond System and Process, the entire contents of which are herein incorporated by reference.

FIELD OF THE INVENTION

The present invention relates to a method for forming nonwoven webs and an apparatus for forming such webs.

BACKGROUND OF THE INVENTION

Many of the personal care products, medical care garments and products, protective wear garments, mortuary and veterinary products in use today are partially or wholly constructed of nonwoven web materials. Examples of such products include, but are not limited to, consumer and professional medical and health care products such as surgical drapes, gowns and bandages, protective workwear garments such as coveralls and lab coats, and infant, child and adult personal care absorbent products such as diapers, training pants, swimwear, incontinence garments and pads, sanitary napkins, wipes and the like. Nonwoven web materials are also widely utilized as filtration media for both liquid and gas or air filtration applications since they can be formed into a filter mesh of fine fibers having a low average pore size suitable for trapping particulate matter while still having a low pressure drop across the mesh.

Nonwoven web materials have a physical structure of individual fibers or filaments which are interlaid in a generally random manner rather than in a regular, identifiable manner as in knitted or woven fabrics. The fibers may be continuous or discontinuous, and are frequently produced from thermoplastic polymer or copolymer resins from the general classes of polyolefins, polyesters and polyamides, as well as numerous other polymers. Blends of polymers or conjugate multicomponent fibers may also be employed. Nonwoven fibrous webs formed by melt extrusion processes such as spunbonding and meltblowing, as well as those formed by dry-laying processes such as carding or air-laying of staple fibers.

Melt extrusion processes for spinning continuous filament or fibers such as spunbond fibers, and for spinning microfibers such as meltblown fibers, and the associated processes for forming nonwoven webs or fabrics therefrom, are well known in the art. Typically, fibrous nonwoven webs such as spunbond nonwoven webs are formed with the fiber extrusion apparatus, such as a spinneret, and fiber attenuating apparatus oriented in the cross-machine direction or "CD". That is, the apparatus is oriented at a 90 degree angle to the direction of web production. The direction of nonwoven web production is known as the "machine direction" or "MD". Although the fibers are laid on the forming surface in a generally random manner, still, because the fibers exit the CD oriented spinneret and attenuating apparatus and are deposited on the MD-moving forming surface, the resulting nonwoven webs have an overall average fiber directionality where more of the fibers are oriented in the MD than in the CD. It is known that such properties as material tensile strength, extensibility and material barrier, for example, are a function of the material uniformity and the directionality of the fibers or filaments in the web. Thus it is highly desirable to finely control material uniformity and the fiber directionality in non-woven webs.

SUMMARY OF THE INVENTION

In general, one aspect of the subject matter described in this specification can be implemented in methods including providing a plurality of fibers from a spinneret; subjecting the fibers to quench air; attenuating the fibers through a closed stretching unit; reducing a velocity of the plurality of fibers in a diffuser that is spaced apart from an exit of the closed stretching unit in a direction of travel of the fibers, the diffuser having opposed diverging sidewalls; and subjecting the fibers to an applied electrostatic charge before the fibers enter the diffuser, wherein the electrostatic charge is applied by one or more electrostatic charging units. Other embodiments of this aspect include corresponding systems and apparatus.

A further aspect of the subject matter described in this specification can be implemented in systems that a spinneret configured to provide a curtain of fibers; a closed stretcher configured to pneumatically attenuate the curtain of fibers; an electrostatic charge device located at a charge position along the closed stretcher and configured to apply an electrostatic charge to said fibers at the charge position, wherein the curtain of fibers has a first width defining a width of the curtain of fibers in a machine direction at a first location along the closed stretcher and has a second width, greater than the first width, defining a width of the curtain of fibers in the machine direction at the charge location wherein the first location is closer to the spinneret than the charge location; a diffuser having a set of opposed diverging walls and configured to receive the curtain of fibers from the closed stretcher and to reduce the velocity of the curtain of fibers; and a forming surface configured to move in the machine direction and to collect the curtain of fibers exiting the diffuser. Other embodiments of this aspect include corresponding methods.

Particular embodiments of the subject matter described in this specification can be implemented so as to realize one or more of the following advantages. For example, applying an electrostatic charge to the curtain of fibers in the closed stretcher, prior to entering the diffuser, allows the individual fiber streams to spread out in the stretcher (as the fiber streams take the same electromagnetic charge and want to repel from one another) thereby facilitating even greater aerodynamic spreading in the diffuser. This allows a more uniform distribution of the curtain of fibers in the cross-direction as the fibers lay down on the forming surface. In essence, applying the electrostatic charge to the curtain of fibers in the stretcher jumps starts fiber spreading prior to the fibers entering the diffuser such that the spreading effect of the diffuser is magnified. This greater uniform distribution promotes enhanced material tensile strength, extensibility and material barrier.

In conventional nonwovens machines the per unit area density of the fiber streams in the curtain limits the throughput of material that can be made over a given time period (i.e., higher fiber stream densities equate to higher throughputs), as at high densities in these conventional systems the fiber streams in the curtains start to stick together or "rope" which results in poor quality material.

However, the electrostatic technology described herein additionally or alternatively allows for higher density fiber curtains (e.g., at market-standard uniformity or even above-market-standard uniformity). For example, because the fiber streams in the curtain are more effectively separated the fiber stream density can be increased which allows higher throughputs of nonwoven material, which provides commercial cost advantages as more material can be made over a given time period.

DEFINITIONS

Figure 1:
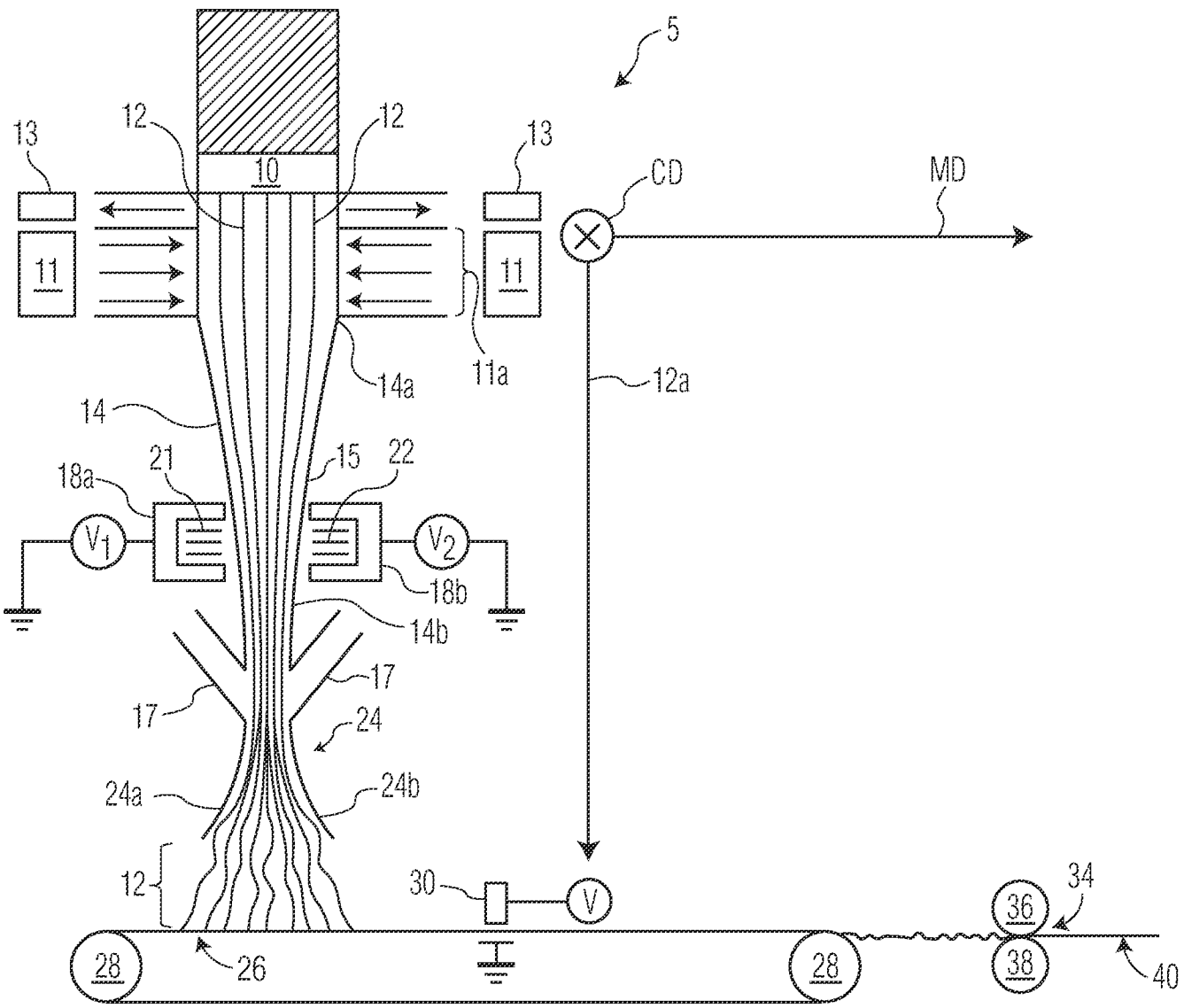
FIG. 1 shows a schematic illustration of an example system for producing a nonwoven web.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

As used herein the term "fibers" refers to both staple length fibers and continuous fibers, also known as filaments, unless otherwise indicated.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are generally present in an amount less than 5 weight percent and more typically about 2 weight percent.

As used herein the term "multicomponent fibers" refers to fibers which have been formed from at least two component polymers, or the same polymer with different properties or additives, extruded from separate extruders but spun together to form one fiber. Multicomponent fibers are also sometimes referred to as conjugate fibers or bicomponent fibers. The polymers are arranged in substantially constantly positioned distinct zones across the cross-section of the multicomponent fibers and extend continuously along the length of the multicomponent fibers. The configuration of such a multicomponent fiber may be, for example, a sheath/core arrangement wherein one polymer is surrounded by another, or may be a side by side arrangement, an "islands-in-the-sea" arrangement, or arranged as pie-wedge shapes or as stripes on a round, oval, or rectangular cross-section fiber.

Multicomponent fibers are taught in, for example, U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75, 80/20 or any other desired ratios.

As used herein the term "biconstituent fiber" or "multiconstituent fiber" refers to a fiber formed from at least two polymers, or the same polymer with different properties or additives, extruded from the same extruder as a blend and wherein the polymers are not arranged in substantially constantly positioned distinct zones across the cross-section of the multicomponent fibers. Fibers of this general type are discussed in, for example, U.S. Pat. No. 5,108,827 to Gessner.

As used herein the term "nonwoven web" or "nonwoven material" means a web having a structure of individual fibers or filaments which are interlaid, but not in an identifiable manner as in a knitted or woven fabric. Nonwoven webs have been formed from many processes such as for example, meltblowing processes, spunbonding processes, air-laying processes and carded web processes. The basis weight of nonwoven fabrics is usually expressed in grams per square meter (gsm) or ounces of material per square yard (osy) and the fiber diameters useful are usually expressed in microns. (Note that to convert from osy to gsm, multiply osy by 33.91).

As used herein, the term "spunbond" or "spunbond nonwoven web" means to a nonwoven fiber or filament material of small diameter fibers that are formed by extruding molten thermoplastic polymer as fibers from a plurality of capillaries of a spinneret. The extruded fibers are cooled while being drawn or elongated. The drawn fibers are deposited or laid onto a forming surface in a generally random manner to form a loosely entangled fiber web, and then the laid fiber web is subjected to a bonding process, e.g., thermal point bonding or through-air bonding, to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al. Typically, spunbond fibers or filaments have a weight-per-unit-length in excess of about 1 denier and up to about 6 denier or higher, although both finer and heavier spunbond fibers can be produced. In terms of fiber diameter, spunbond fibers generally have an average diameter of larger than 7 microns, and more particularly between about 10 and about 25 microns, and up to about 30 microns or more.

As used herein the term "meltblown fibers" means fibers or microfibers formed by extruding a molten thermoplastic material through a plurality of fine, usually circular, die capillaries as molten threads or fibers into converging high velocity gas (e.g. air) streams which attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are generally smaller than 10 microns in average diameter and are often smaller than 7 or even 5 microns in average diameter, and are generally tacky when deposited onto a forming surface.

As used herein, "thermal point bonding" involves passing a fabric or web of fibers or other sheet layer material to be bonded between a heated calender roll and an anvil roll. The calender roll is usually, though not always, patterned on its surface in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. Thermal point bonding imparts integrity to individual layers by bonding fibers within the layer and/or for laminates of multiple layers, point bonding holds the layers together to form a cohesive laminate.

As used herein, the term "protrusions" means a structure which extends outward from another structure. The protrusions can extend into the fiber curtain passing through the electrostatics unit or can be recessed in a cavity such that they do not extend into the fiber curtain, but extend from a structure with the cavity. In the present invention, the protrusions can be rods, bars, a wire, a loop of wire or pins.

As used herein, the term "array" means a matrix of protrusions. The matrix can be, for example, one row of protrusions extending the width of the cross machine direction of a spunbond system or a series of rows.

DETAILED DESCRIPTION OF THE INVENTION

The present disclosure generally relates to an improved process for using electrostatics in a closed spunbond system and attendant equipment. For example, the closed spunbond system includes a spinneret that creates or extrudes a multitude of molten polymer streams and feeds those molten streams into quench box that directs air into the streams to partially cool and crystalize the streams. The partially crystalized streams are then directed down into a closed stretching unit that narrows causing the air introduced from the quench box to accelerate thereby stretching and attenuating the streams to decrease their diameter and lengthen them.

Given that the streams are not yet fully crystallized and are tacky, if adjacent streams touch they could become intertwined or bundled, which undesirably affects the quality of the nonwoven web produced by the spunbond machine. More generally, if the streams are not well distributed across the extent of the cross sectional area of the stretcher the non-woven webs formed by these streams often lacks the fiber uniformity desired for many end uses. As advancements increase the density of polymer streams bundling or poor uniformity becomes more likely.

To combat this issue the present spunbond machine includes a device in the stretcher that applies an electrostatic charge to the streams to cause the streams to be like charged (e.g., all the streams have positive or all streams have negative electrical charges). Thus the streams repel each other, which reduces bundling and promotes good nonwoven web uniformity as the fibers spread out across the extent of the stretcher, as compared to implementations where no such electrostatic charge is applied.

With the streams, at least partially spread in the stretcher, the streams travel down out of the stretcher into the diffuser, which serves to reduce the velocity of the streams and further spread the streams in preparation to lay the streams down on a forming surface that collects the streams as a nonwoven web. Because the streams are spread in the stretcher the diffuser is more effectively able to further spread the streams prior to web formation on the forming surface. This improved process is described below in additional detail with reference to FIG. 1, which is a schematic illustration of an example system 5 for producing a nonwoven web.

The spinplate or spinneret 10 receives polymer from a conventional melt extrusion system (not shown) and forms (molten) fibers 12 which may be monocomponent, multicomponent (conjugate) or biconstituent fibers, as described above. The spinplate 10 has openings (not shown) arranged in one or more rows or other configurations. As the molten polymer is extruded through the openings in the spinplate 10 the polymer forms a downwardly extending "curtain" or "bundle" of fibers 12. An example spinplate 10 for producing such fibers is described in U.S. Pat. No. 5,989,004 to Cook, the entire contents of which are herein incorporated by reference. In some implementations, the openings in the spinplate 10 have a density (measured in a plane orthogonal to the fiber flow direction 12*a*) of 100 to 350, preferably 168 to 350 and more preferably 215 to 275 openings per inch in the MD (i.e., openings/inch/MD). In FIG. 1, the fiber flow direction 12*a* and MD are shown and the cross-machine direction (CD) is orthogonal to each of the fiber flow and MD axis and goes into and out of the page. For additional reference, the upstream side, machine direction side of the system has electrostatics unit 18*a* and the downstream side, machine direction side of the system has electrostatics unit 18*b*.

Polymers suitable for use in the system 5 include, for example, polyolefins, polyesters, polyamides, polycarbonates and copolymers, and polyhydroxyacids (PHAs) and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(l-butene) and poly(2-butene); polypentene, e.g., poly(l-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polylactide and polylactic acid polymers as well as polyethylene terephthalate, poly-butylene terephthalate, polytetramethylene terephthalate, polycyclohexylene-1,4-dimethylene terephthalate, and isophthalate copolymers thereof, as well as blends thereof.

During the extrusion of polymer from the spinplate 10, monomer fumes may be released, which can accumulate and cause process instability. To avoid monomer accumulation, the system 5 includes a monomer exhaust 13 to pull out and extract at least some of the released monomer fumes. In some implementations, the monomer exhaust 13 is placed functionally below the spinplate 10 (and to the side(s) of the channel through the curtain of fibers 12 flow down).

As the curtain of fibers continue to travel down in the fiber flow direction 12*a* then pass into a quench zone 11*a*. To this end, in some implementations, the system 5 includes a quenching mechanism designed to solidify or partially solidify the polymer(s) in the curtain of fibers 12. For example, as the molten, extruded polymer of the curtain of fibers 12 exits the spinplate 10, it passes through the zone 11*a* having air introduced from one or more quench blowers 11. In some implementations, there is a quench blower 11 on one side (e.g., an upstream, machine-direction side of the system 5) while in other implementations there are quench blower 11 on both the upstream and downstream, machine-direction sides of the system 5. Further, in some implementations, there are multiple quench blowers along the fiber flow direction 12*a* of the system 5 such that the curtain of fibers 12 passes through a first quench zone and then further down in the fiber flow direction passes through one or more additional quench zones of other quench blowers.

More generally described the quench blower(s) 11 are positioned adjacent the curtain of fibers 12 extending from the spinplate 10, and air from the quench blower 11 quenches the fibers 12. The term "quench" means reducing the temperature of the fibers 12 using a medium that is cooler than the fibers 12 such as using, for example, chilled air streams, ambient temperature air streams, or slightly to moderately heated air streams, for example, to solidify or partially solidify the polymer(s) in the curtain of fibers 12.

The system 5 includes a closed stretcher 14. The stretcher 14 is positioned below (in the fiber flow direction 12*a*) the spinplate 10 and the quench blower 11. The stretcher 14 receives the quenched curtain of fibers 12. Generally described, the stretcher 14 includes an elongated vertical passage 15 through which the fibers are drawn by quench air entering from the quench blower(s) 11 and flowing downwardly through the passage 15. The quench air applies drawing forces on the fibers 12 and pulls the fibers 12 through the passage 15 of the stretcher 14 and by the application of the drawing forces attenuates the fibers 12, that is, elongates and reduces the diameter of the fibers 12. In some implementations, the fibers 12 have a velocity, in fiber flow direction 12*a*, in the stretching unit 14 of between 8000 to 14000 feet per minute, preferably 12000 to 14000 feet per minute and more preferably 13000 to 14000 feet per minute. As described above the stretcher 14 (and more generally the system 5) is closed, meaning that besides the air introduced from the quench blower(s) 11, no other air is introduced prior to or within the stretcher 14 to facilitate fiber attenuation/draw.

Between the top 14a (e.g., immediately below the quench zone 11*a*) and bottom 14*b* (e.g., immediately above the diffuser 24) of the stretcher 14, the system 5 includes electrostatics unit 18 positioned adjacent passage 15. In some implementations, the electrostatics unit 18 includes two electrostatic devices, one on the upstream, machine-direction side of the system 5 and one on the downstream, machine-direction side of the system 5. In other implementations, the electrostatics unit 18 includes one electrostatic device on either the upstream, machine-direction side or downstream, machine-direction side of the system 5. Generally, the electrostatics unit 18 functions to place an electrical charge (either a positive or negative electrical charge on the fibers 12, depending on configuration), as described in further detail below. In some implementations, the stretching unit 14 has a machine direction width of between 0.6 to 2.5 inches, preferably 1 to 2 inches more preferably 1.25 to 1.75 inches at a location in the passage 15 adjacent the electrostatics unit 18 (e.g., where the electrostatic charge is applied to the fibers 12).

In some implementations, below the stretcher 14, in the fiber flow direction 12*a*, the system 5 includes a diffuser 24. As described in U.S. Pat. No. 5,814,349 it is desirable for the diffuser 24 to be mounted at or slightly below the exit of the stretcher 14 to allow for ambient air to be drawn into the diffuser 24 from the sides at slots 17. As shown in FIG. 1, the diffuser 24 is formed between the opposed sidewalls 24*a* and 24*b*, and these opposed sidewalls diverge, that is, opposed sidewalls 24*a* and 24*b* slope outwardly in the direction of fiber flow 12*a* in such a way that the volume of the diffuser 24 expands as the lower portion of the diffuser 14 nears the forming surface 26. In some implementations the sidewalls 24*a* and 25*b* may converge and then diverge in the direction of fiber flow 12*a* in a parabolic shape.

In some implementations, the opposed sidewalls 24*a* and 24*b* are continuous and unvented, so that jet of aspirating air pulled in from the slots 17 does not escape from the diffuser 24 until it exits the bottom of the diffuser 24 nearest the forming surface 26. In some implementations, the sidewalls 24*a* and 24*b* diverge at an angle of 5 degrees but are adjustable and thus the angle of divergence and be changed such that the angle of divergence may be greater or less than 5 degrees. The gradually expanding or increasing volume of diffuser 24 allows for the jet of fast-moving aspirating air to gradually expand into the increasing volume as it passes through the diffuser 24.

As the jet of aspirating air from the slots 17 (combined with the quench air flowing through the stretcher 14 and into the diffuser 24) travels in the fiber travel direction 12*a* through the diffuser 24 it decreases in velocity, and the fiber velocity also decreases, which allows for the fibers 12 to spread out in the machine direction. That is, as the curtain of fibers 12 travels downward through the diffuser 24, it begins to take on a machine direction dimension which is somewhat larger than it had while between in the stretcher 14, even considering the machine direction spreading effects of the electrostatics unit 18 as described below.

From the diffuser 24, the fibers 12 are directed to and collect on the forming surface 26. The forming surface 26 travels in the machine direction and moves around rolls 28, one or both of which may be driven with a motor (not shown). The collection of fibers 12 on the forming surface, now a nonwoven web, may be consolidated by bonding nip 34 between calendar rolls 36, 38 (one or both of which may be patterned as described above) to form a bonded web 40. Other methods of bonding the resulting nonwoven web, such as through air bonding may also or additionally be used. If desired, a charge removing device 30 (e.g., similar to the electrostatics unit 18 but applying an opposite charge as the electrostatics unit 18) for neutralizing or reducing the charge on the nonwoven web may optionally be employed. The system 5 can make fibers having, for example, a weight-per-unit-length 0.7 denier and up to about 1.6 denier or higher.

In some implementations, the electrostatics unit 18 includes rows 22 of protrusions on a first side of the electrostatics unit 18*b*, and rows of protrusions 21 on a second side of the electrostatics unit 18*a*. A potential or voltage is applied to the protrusions 22, 21 on one or both sides of the electrostatics unit 18 via a power supply V1 or V2 to cause a potential difference across the protrusions 22, 21. This difference in potential is commonly referred to as a potential or voltage bias. Alternatively, one side of the electrostatic unit 18 and its protrusions (one of 22 or 21) may be grounded and the other side will have a potential applied to the protrusions (the other of 22 or 21).

In some implementations, the potential difference (whether between two electrostatics units on either side of the stretcher 14 as shown in FIG. 1 or between protrusions 21 in a single electrostatic charge unit 18) can be, for example, 10 to 25 kilovolts or more preferably 16 to 18 kilovolts. In some implementations, the electrical current supplied to a given electrostatic unit (e.g., 18*a* or 18*b*) is in the range of 0.2 and 0.8 milliamps and more preferably in the range of 0.2 and 0.6 milliamps and even more preferably about 0.4 milliamps.

As shown in FIG. 1, the potential difference between the protrusions 22 and 21 produce a corona discharge, resulting in an electrostatic charge being placed on the fibers 12 in proximity to the electrostatics unit 18. Once charged, the fibers 12 tend to repel one another, thereby preventing groups of individual fibers 12 from clumping, bundling or "roping" together. The configuration of the electrostatics unit 18 is described in further detail below, with reference to FIGS. 2A and 2B and FIG. 3.

Figure 2A:
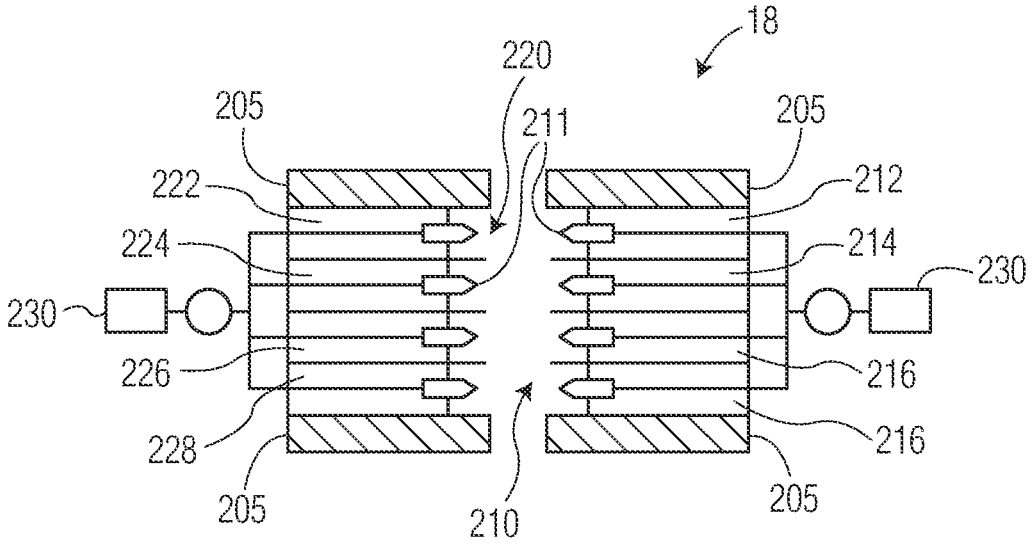
FIGS. 2A and 2B each show an exemplary device for applying an electrostatic charge to the fibers.

Referring to FIG. 2A, another example electrostatics unit 18 is shown in a side view. The electrostatic unit 18 has a first array of electrodes 210 on a first side of the electrostatic unit 18 and a second array of electrodes 220 on a second side of the electrostatic unit 18, wherein the electrodes 220, 210 are opposed to one another. As shown, the electrodes 210 and 220, each have a series of multiple bars extending substantially along the cross-machine width of the stretcher 14, for example four bars 212, 214, 216 and 218 associated with the first array of electrodes 210 and four bars 222, 224, 226, and 228 associated with the second array of electrodes 220, each with a plurality of protrusions 211. The protrusions 211 can be rods, loops, including loops or wire or pins and are desirable emitter pins 211. The bars in each array are held in place by an electrically insulating material 205, which also serves to isolate the electrostatic unit 18 from the other equipment of the process, such as the stretcher 14. The charge bars are powered by a power supply 230, or is in the alternative grounded, if the pins 211 on the other side of the electrostatic unit 18 are powered by a power supply.

In some implementations, the emitter pins 211 are desirable recessed within the insulation material to prevent the fibers 12 from fouling the emitter pins 211. Fouling of the emitter pins 211 can be caused by the fibers 12 catching on the emitter pins 211 since the pins 211 have relatively sharp tips to better generated the electrostatic charge.

Figure 2B:
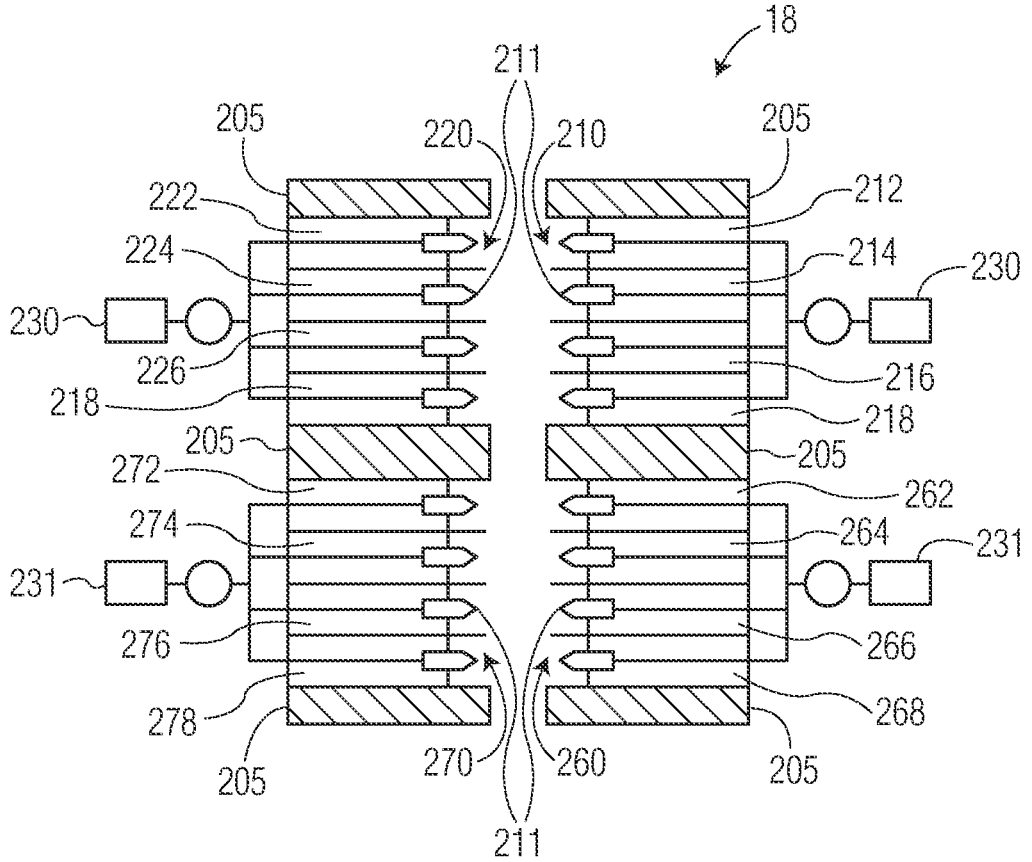

Referring to FIG. 2B, another example electrostatic unit arrangement 18 is shown in a side view. The electrostatic unit 18 has a first array of electrodes 210 and a third array of electrodes 260 on a first side of the electrostatic unit 18 and a second array of electrodes 220 and a fourth array of electrodes 270 on a second side of the electrostatic unit 18. As shown, the electrode arrays 210, 220, 260 and 270 each have a series of multiple bars extending substantially along the cross-machine width of the stretcher 14, for example four bars 212, 214, 216 and 218 associated with the first array of electrodes 210 and four bars 222, 224, 226, and 228 associated with the second array of electrodes 220, four bars 262, 264, 266 and 268 associated with the third array of electrodes 260 and four bars 272, 274, 276, and 278 associated with the fourth array of electrodes 270 each with a plurality of protrusions 211, which are can be, for example, emitter pins 211. The bars are held in place by an electrically insulating material 205, which also serves to isolate the electrostatic unit 18 from the other equipment of the process, such as the stretcher 14. Each of the charge bars, for example, is powered by a power supply 230 or 231, or is, in the alternative, grounded, if the pins 211 on the other side of the electrostatic unit 18 is powered by a power supply.

As shown in FIG. 2A and FIG. 2B, the protrusions 211 are on either side of the electrostatic unit 18 and are opposed to each other. The electrostatic charge is generated between the protrusions 211 or emitter pins 211.

Figure 3:
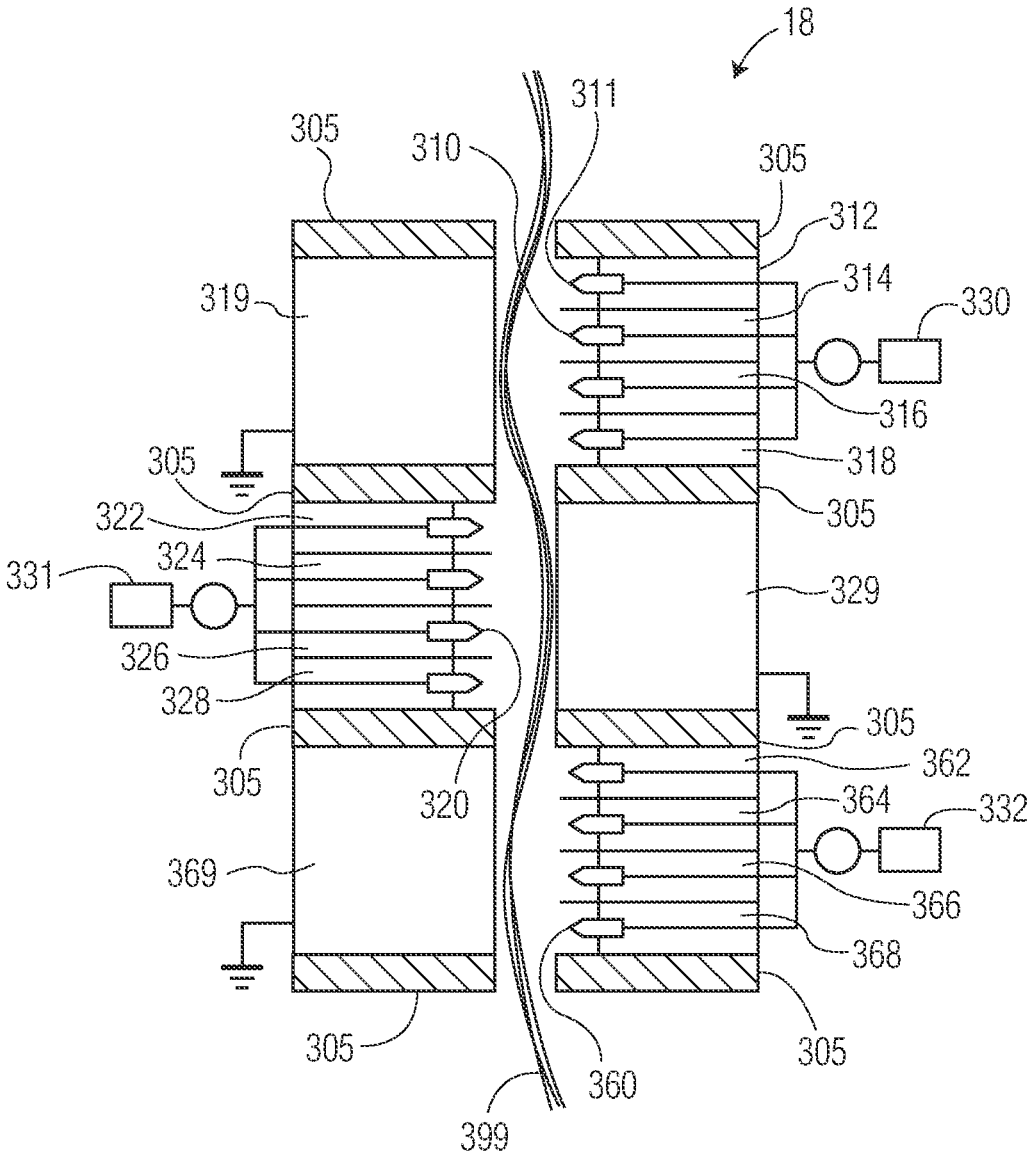
FIG. 3 shows an exemplary device for applying an electrostatic charge to the fibers.

FIG. 3 shows yet another example electrostatic unit 18 in a side view. The electrostatic unit 18 has a first section has a first array of electrodes 310 on a first side of the electrostatic unit 18. This array of electrodes has a series of multiple bars extending substantially along the cross-machine width of the stretcher 14, for example four bars 312, 314, 316 and 318 associated therewith, each with a plurality of protrusions 311. The bars are connected to a power supply 330 which provides a potential or voltage to the pins 311. On a second side of the electrostatic unit 18, directly across from the array of electrodes 311 is a target 319, which is shown to be grounded. In the alternative the target 319 may also be attached to a power supply, provided that a bias is established, as described above. In FIG. 3, the protrusions 311 on the first side and the second side are offset and are not directly opposed to one another. The bars in each array are held in place by an electrically insulating material 305, which also serves to isolate the electrostatic unit 18 from the other equipment of the process, such as the stretcher 14.

In addition, the insulation material 305 insulates the first section of the electrostatic unit 18 from other sections of the electrostatic unit 18. In a second section of the electrostatic unit 18, this section has a second array of electrodes 320 on a second side of the electrostatic unit 351. This array of electrodes 320 has a series of multiple bars extending substantially along the cross-machine width of the stretcher 14, for example four bars 322, 324, 326 and 328 associated therewith, each with a plurality of protrusions 311, shown as pins 311. The bars are attached to a power supply 330 on the first side of the electrostatic unit 18, directly across from the array of electrodes 320 is a target 329. Like the first section of the electrostatic unit 18, the bars of the second section are held in place by an electrically insulating material 305, which also serves to isolate the second section of the electrostatic unit 18 from the first section and an optional third section. In addition, a power supply is connected to the bars, hence the protrusions 320 and the target is shown to be grounded, but in other implementations may be attached to a power supply.

In an optional third section of the electrostatic unit 18, this section has a third array of electrodes 360 on a first side of the electrostatic unit 18. This array of electrodes 360 has a series of multiple bars extending substantially along the cross-machine width of the stretcher 14, for example four bars 362, 364, 366 and 368 associated therewith, each with a plurality of protrusions 311. On the second side of the electrostatic unit 18, directly across from the array of electrodes 360 is a target 369. Like the first and second sections of the electrostatic unit 18, the bars of the third section are held in place by an electrically insulating material 305, which also serves to isolate the third section of the electrostatic unit 18 from the second section and an optional additional sections of the electrostatics unit 18 and the bars are connected to a power supply. Additional sections can be added below the optional third section, provided that the array of electrodes is on the opposite side of the previous section of the electrostatics unit 18.

The protrusions (e.g., 211) of an example electrostatic unit 18 may be a pin, a rod, a wire or a looped wire. Desirably, the protrusions are pins, most desirably emitter pins. An exemplary emitter pin configuration is one where the emitter pins are spaced apart at ¼ inch, and recessed at ⅛ inch in a cavity of 0.5 inch high×0.25 inch deep. The actual spacing of the pins can be varied to achieve the desired corona discharge. The pins are typically arranged in rows which can be as wide or slightly narrower than the stretcher 14. Further, in some implementations the emitter pins are recessed.

The protrusions (e.g. 211) can be stacked in several rows, for example, from 2-50 rows or more. Alternatively, there can be a single row of protrusions.

In some implementations only the electrostatics unit 18 is only on one side of the stretcher 14, e.g., only on the upstream or downstream side in the machine direction. In this case one row of protrusions 21 may have a positive potential and another row may have a negative potential or be grounding to create a potential difference to generate a corona to charger the fibers 12.

Figure 4A:
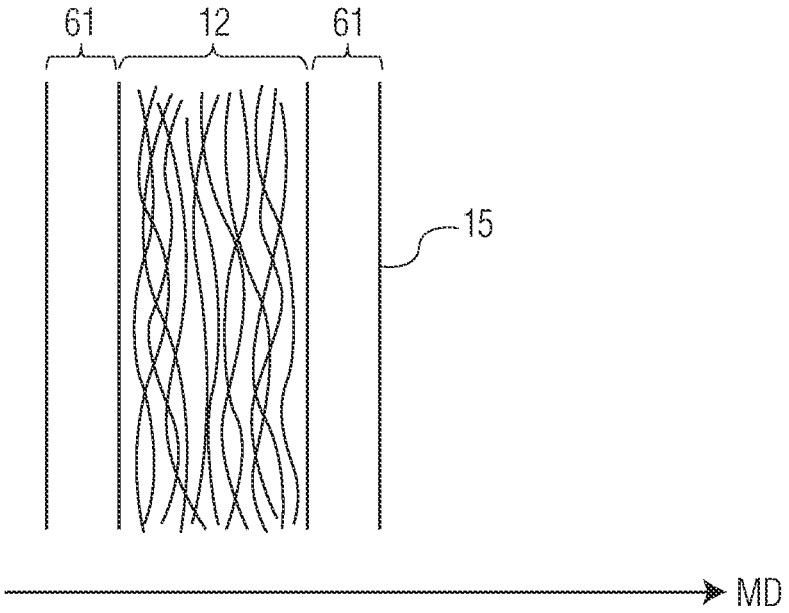
FIG. 4A shows an illustration of fibers in the stretcher without an electrostatics unit.
Figure 4B:
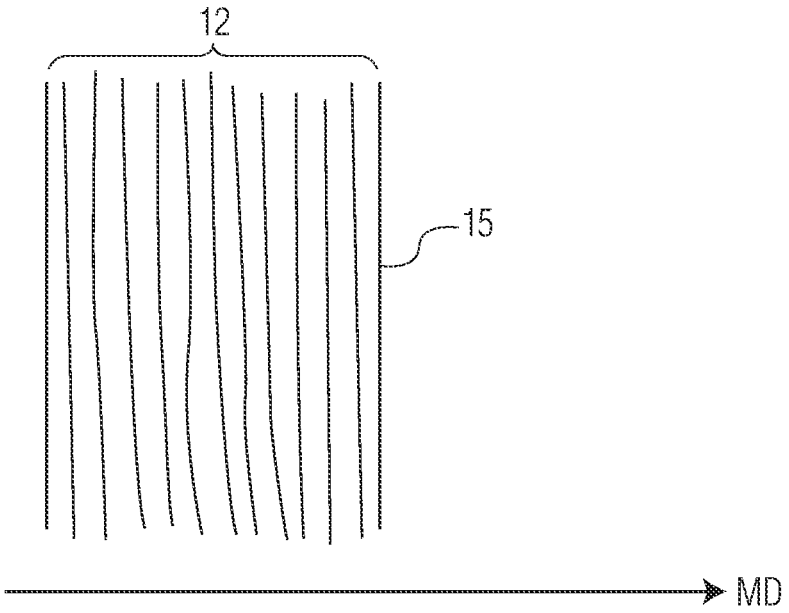
FIG. 4B shows an illustration of fibers in the stretcher with an electrostatics unit.

Regardless of the particular implementation, the electrostatics unit 18 serves to spread out of the bundle in the stretcher 14. This effect is shown in FIGS. 4A and 4B. More specifically, FIG. 4A shows a cutaway view of fibers 12 in the passage 15 of the stretcher 14 at the location of the electrostatics unit 18 with the machine direction (MD) shown for reference. This view, with the electrostatics unit turned off, shows that the fibers 12 are not well spread out as there are open gaps (G1) in the passage 15. To the contrary, FIG. 4B shows the same view, but with the electrostatics unit 18 turned on. As shown in FIG. 4B, the fibers 12 are spread out to a greater extent than those in FIG. 4A, which is attributable to the effects from the electrostatics unit 18 charging the fibers 12 and causing them to repel from one another. More generally, the applying the electrostatic charge to the fibers 12 in the stretcher 14 causes the width, in the machine direction, of the curtain of fibers 12 in the stretcher 14 to be greater than the width of the curtain of fibers 12 at that same location in the stretcher 14 not having such a charge applied.

As described above, nonwovens webs made from the system 5 have improved properties such as uniformity, as shown by a nonwovens web made on the system 5 having a coefficient of variation of basis weight of between 2.8% to 4%, and more preferably of 3 to 3.5%. This basis weight test method was performed with the following process: Take full width (CD) sample of web and Z-fold sample into 3 layers. Cut 4 inch×4 inch samples along the CD of the sample, with a minimum of ten 4 inch×4 inch samples. (Samples are to be positioned as close to each other as possible, i.e., leave as little gap between samples as possible.) In this way collect 1 through N three-layer (4×4 inch) samples. Each 3-layer sample should be weighed. Then determine the average weight of all samples (Avg(W)), and determine the standard deviation for all samples (SD). Then determine the coefficient of variation by dividing Avg(W) by SD ((Avg(W)/SD) and multiplying by 100. So the coefficient of variation of the basis weight is ((Avg(W)/SD)*100.

Implementations

Implementation 1. A method of making a nonwoven web, the method comprising:

providing a plurality of fibers from a spinneret;

subjecting the fibers to quench air;

attenuating the fibers through a closed stretching unit;

reducing a velocity of the plurality of fibers in a diffuser that is spaced apart from an exit of the closed stretching unit in a direction of travel of the fibers, the diffuser having opposed diverging sidewalls; and subjecting the fibers to an applied electrostatic charge before the fibers enter the diffuser, wherein the electrostatic charge is applied by one or more electrostatic charging units.

Implementation 2. The method of implementation 1, comprising collecting the fibers into a web on a forming surface.

Implementation 3. The method of implementations 1 or 2, wherein the one or more electrostatic charging units are located proximate a bottom half of the closed stretching unit.

Implementation 4. The method of implementations 1 or 2, wherein the one or more electrostatic charging units are located proximate a top half of the closed stretching unit.

Implementation 5. The method of implementations 1-4, wherein each of the one or more electrostatic charging units produce between 10 and 25 kilovolts.

Implementation 6. The method of implementations 1-5, wherein each of the one or more electrostatic charging units produce between 16 and 18 kilovolts.

Implementation 7. The method of implementations 1-6, wherein each of the one or more electrostatic charging units produce between 0.2 and 0.8 milliamps.

Implementation 8. The method of implementations 1-7, wherein each of the one or more electrostatic charging units produce between 0.2 and 0.6 milliamps.

Implementation 9. The method of implementations 1-8, wherein each of the one or more electrostatic charging units produce about 0.4 milliamps.

Implementation 10. The method of implementations 1-9, comprising collecting the fibers into a web on a forming surface, wherein the web has a basis weight coefficient of variation of between 3 and 3.5%.

Implementation 11. The method of implementations 1-10, wherein the plurality of fibers from the spinneret have a density, in an area orthogonal to the direction of travel of the fibers, of 100 to 350, preferably 168 to 350 and more preferably 215 to 275 openings per inch in the MD.

Implementation 12. The method of implementations 1-11, wherein the plurality of the fibers have a velocity in the closed stretching unit of between 8000 to 14000 feet per minute, preferably 12000 to 14000 feet per minute and more preferably 13000 to 14000 feet per minute.

Implementation 13. The method of implementations 1-12, wherein, in a machine direction, the closed stretching unit has a width of between 0.6 to 2.5 inches, preferably 1 to 2 inches more preferably 1.25 to 1.75 inches at a location in the closed stretching unit where the electrostatic charge is applied to the plurality of fibers.

Implementation 14. The method of implementations 1-13, wherein the electrostatic charge is applied by two or more oppositely directed electrostatic charging units.

Implementation 15. A system comprising a spinneret configured to provide a curtain of fibers; a closed stretcher configured to pneumatically attenuate the curtain of fibers; an electrostatic charge device located at a charge position along the closed stretcher and configured to apply an electrostatic charge to said fibers at the charge position, wherein the curtain of fibers has a first width defining a width of the curtain of fibers in a machine direction at a first location along the closed stretcher and has a second width, greater than the first width, defining a width of the curtain of fibers in the machine direction at the charge location wherein the first location is closer to the spinneret than the charge location; a diffuser having a set of opposed diverging walls and configured to receive the curtain of fibers from the closed stretcher and to reduce the velocity of the curtain of fibers; and a forming surface configured to move in the machine direction and to collect the curtain of fibers exiting the diffuser.

Implementation 16. The system of implementation 15, wherein each of the one or more electrostatic charging units produce between 10 and 25 kilovolts.

Implementation 17. The system of implementations 15-16, wherein each of the one or more electrostatic charging units produce between 16 and 18 kilovolts.

Implementation 18. The system of implementations 15-17, wherein each of the one or more electrostatic charging units produce between 0.2 and 0.8 milliamps.

Implementation 19. The system of implementations 15-18, wherein each of the one or more electrostatic charging units produce between 0.2 and 0.6 milliamps.

Implementation 20. The system of implementations 15-19, wherein each of the one or more electrostatic charging units produce about 0.4 milliamps.

Implementation 21. The system of implementations 15-20, comprising collecting the fibers into a web on a forming surface, wherein the web has a basis weight coefficient of variation of between 3 and 3.5%.

Implementation 22. The system of implementations 15-21, wherein the plurality of fibers from the spinneret have a density, in an area orthogonal to the direction of travel of the fibers, of 100 to 350, preferably 168 to 350 and more preferably 215 to 275 openings per inch in the MD.

Implementation 23. The system of implementations 15-22, wherein the plurality of the fibers have a velocity in the closed stretching unit of between 8000 to 14000 feet per minute, preferably 12000 to 14000 feet per minute and more preferably 13000 to 14000 feet per minute.

Implementation 24. The system of implementations 15-23, wherein, in a machine direction, the closed stretching unit has a width of between 0.6 to 2.5 inches, preferably 1 to 2 inches more preferably 1.25 to 1.75 inches at a location in the closed stretching unit where the electrostatic charge is applied to the plurality of fibers.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A method of making a nonwoven web, the method comprising:

providing a plurality of fibers from a spinneret;

subjecting the fibers to quench air;

attenuating the fibers through a closed stretching unit;

reducing a velocity of the plurality of fibers in a diffuser that is spaced apart from an exit of the closed stretching unit in a direction of travel of the fibers, the diffuser having opposed diverging sidewalls; and subjecting the fibers to an applied electrostatic charge in the closed stretching unit before the fibers enter the diffuser, wherein the electrostatic charge is applied by one or more electrostatic charging units.

2. The method of claim 1, comprising collecting the fibers into a web on a forming surface.

3. The method of claim 1, wherein the one or more electrostatic charging units are located proximate a bottom half of the closed stretching unit.

4. The method of claim 1, wherein the one or more electrostatic charging units are located proximate a top half of the closed stretching unit.

5. The method of claim 1, wherein each of the one or more electrostatic charging units produce between 10 and 25 kilovolts.

6. The method of claim 5, wherein each of the one or more electrostatic charging units produce between 16 and 18 kilovolts.

7. The method of claim 6, wherein each of the one or more electrostatic charging units produce between 0.2 and 0.8 milliamps.

8. The method of claim 7, wherein each of the one or more electrostatic charging units produce between 0.2 and 0.6 milliamps.

9. The method of claim 8, wherein each of the one or more electrostatic charging units produce about 0.4 milliamps.

10. The method of claim 9, comprising collecting the fibers into a web on a forming surface, wherein the web has a basis weight coefficient of variation of between 3 and 3.5%.

11. The method of claim 10, wherein the plurality of fibers from the spinneret have a density, in an area orthogonal to the direction of travel of the fibers, of 100 to 350.

12. The method of claim 11, wherein the plurality of the fibers have a velocity in the closed stretching unit of between 8000 to 14000 feet per minute.

13. The method of claim 11, wherein, in a machine direction, the closed stretching unit has a width of between 0.6 to 2.5 inches at a location in the closed stretching unit where the electrostatic charge is applied to the plurality of fibers.

14. The method of claim 1, wherein the electrostatic charge is applied by two or more oppositely directed electrostatic charging units.

15. A system comprising:

a spinneret configured to provide a curtain of fibers;

a closed stretcher configured to pneumatically attenuate the curtain of fibers;

an electrostatic charge device located at a charge position along the closed stretcher and configured to apply an electrostatic charge to said fibers at the charge position, wherein the curtain of fibers has a first width defining a width of the curtain of fibers in a machine direction at a first location along the closed stretcher and has a second width, greater than the first width, defining a width of the curtain of fibers in the machine direction at the charge location wherein the first location is closer to the spinneret than the charge location;

a diffuser having a set of opposed diverging walls and configured to receive the curtain of fibers from the closed stretcher and to reduce the velocity of the curtain of fibers; and a forming surface configured to move in the machine direction and to collect the curtain of fibers exiting the diffuser.

16. The system of claim 15, wherein each of the one or more electrostatic charging units produce between 10 and 25 kilovolts.

17. The system of claim 16, wherein each of the one or more electrostatic charging units produce between 16 and 18 kilovolts.

18. The system of claim 17, wherein each of the one or more electrostatic charging units produce between 0.2 and 0.8 milliamps.

19. The system of claim 18, wherein each of the one or more electrostatic charging units produce between 0.2 and 0.6 milliamps.

20. The system of claim 19, wherein each of the one or more electrostatic charging units produce about 0.4 milliamps.

21. The system of claim 20, comprising collecting the fibers into a web on a forming surface, wherein the web has a basis weight coefficient of variation of between 3 and 3.5%.

22. The system of claim 20, wherein the plurality of fibers from the spinneret have a density, in an area orthogonal to the direction of travel of the fibers, of 100 to 350.

23. The system of claim 22, wherein the plurality of the fibers have a velocity in the closed stretching unit of between 8000 to 14000 feet per minute.

24. The system of claim 23, wherein, in a machine direction, the closed stretching unit has a width of between 0.6 to 2.5 inches at a location in the closed stretching unit where the electrostatic charge is applied to the plurality of fibers.

* * * * *